United States Patent [19]

Mitschik et al.

[11] Patent Number: 5,065,127

[45] Date of Patent: Nov. 12, 1991

[54] LEAF SPRING FOR AN ELECTROMAGNETIC RELAY

[75] Inventors: Herbert Mitschik, Geretsried; Fritz Hinrichs, Wolfratshausen, both of Fed. Rep. of Germany

[73] Assignee: Siemens Aktiengesellschaft, Munich, Fed. Rep. of Germany

[21] Appl. No.: 649,266

[22] Filed: Jan. 30, 1991

Related U.S. Application Data

[63] Continuation of Ser. No. 449,804, Dec. 13, 1989, abandoned.

[30] Foreign Application Priority Data

Dec. 23, 1988 [EP] European Pat. Off. ..... 88121581

[51] Int. Cl.[5] ..... H01F 7/08; H01H 50/60

[52] U.S. Cl. ..... 335/270; 335/128; 335/276

[58] Field of Search ..... 337/270, 274, 275, 276, 337/277, 128, 135

[56] References Cited

U.S. PATENT DOCUMENTS 4,429,292 1/1984 Schedele ..... 335/128
4,670,727 6/1987 Muller et al. ..... 335/274
4,684,910 8/1987 Dittmann et al. ..... 335/274
4,818,965 4/1989 Hinrichs et al. ..... 335/274

FOREIGN PATENT DOCUMENTS 1094366 12/1960 Fed. Rep. of Germany .
7033403 9/1970 Fed. Rep. of Germany .

*Primary Examiner*—Harold Broome
*Attorney, Agent, or Firm*—Hill, Van Santen, Steadman & Simpson

[57] ABSTRACT

A relay includes a leaf spring for bearing an armature at a free end of a yoke, the leaf spring forming, first, a bearing plate lying against the yoke and, second, a pull-back spring applied thereto in one piece. The pull-back spring has a first section cut free from the middle of the bearing plate so that the bearing plate is subdivided into two plate sections on which the armature rests only at its lateral regions on its bearing edges. Further, the pulled-back spring as its free end cut arcuately roughly symmetrical to the center axis of the bearing plate to exert an approximately symmetrical pull-back force on the armature.

14 Claims, 3 Drawing Sheets

LEAF SPRING FOR AN ELECTROMAGNETIC RELAY

This is a continuation of application Ser. No. 449,804, filed Dec. 13, 1989, abandoned.

BACKGROUND OF THE INVENTION

1. Field of the Invention

The present invention is directed generally to an electromagnetic relay having a coil, a core and a yoke as well as a flat armature seated at one free end of the yoke and, more particularly, relates to a leaf spring for an electromagnetic relay for bearing and resetting the armature, whereby the leaf spring forms a bearing plate that rests against an outside surface of the yoke and projects beyond the end of the yoke so that a bearing notch is formed for a bearing edge of the armature between the end face of the yoke and the bearing plate. A pull-back spring is integrally applied to the bearing plate in one piece therewith, embraces the bearing edge of the armature, and has a section extending in an opposite direction relative to the bearing plate and engaging into a recess of the armature.

2. Description of the Related Art

European patent application No. EP-A-0 251 034 discloses such a relay. In one of the embodiments shown therein the bearing plate and the pull-back spring are formed in one piece. The pull-back spring that is applied to the end of the bearing plate, however, needs a relatively large space to achieve a great spring length and thus provide a soft, or weak, spring characteristic. The illustrated spring is nonetheless still relatively strong. Since there is still a relatively high amount of friction in the region of the armature bearing, the pull-back spring cannot be made too weak. To guarantee a reliable response of the disclosed relay in view of the relatively great amount of friction and the relatively strong pull-back spring, a larger magnetic system must be provided which requires higher excitation power. However, the response or excitation power should be kept as low as possible.

SUMMARY OF THE INVENTION

An object of the present invention is to provide a low power consumption relay in which less response power is required due to lower armature bearing friction and a softer, or weaker, pullback spring on the armature opposing the electro-magnetic pull of the coil. This is accomplished by providing a redesigned bearing spring in a relay of the initially cited species. A further object is to provide a softer, or weaker, pull-back spring which uses optimally little space and is easy to manufacture and to mount.

These and other objects and advantages of the invention are achieved in a relay pull-back spring having a first section which is cut-out from a center region of a bearing plate to form a straight spring-tongue portion and that subdivides the bearing plate into two plate sections on which only the lateral regions of the bearing edge of the relay armature rest. The free end of the pull-back spring has a section which is arcuately cut in a plane of the leaf spring. This section extends approximately uniformly at both sides of a symmetry plane that intersects the spring tongue.

The critical element of the armature bearing of the invention is, thus, the specifically shaped leaf spring that meets various functions. When the spring is viewed extending in a plane, the pull-back spring is composed of a straight section in the region of the bearing plate and of an approximately accurate or nearly annular section that is essentially symmetrical to the axis of the straight region whereby the overall shape of the spring is that of a question mark. Not only does this achieve a relatively great spring length with little space requirements, but also the spring attacks, or exerts its force, on the armature in the proximity of the armatures center axis so that the bearing forces are approximately symmetrically distributed. As a result of the central tongue-shaped spring section of the pull-back spring cutout from the bearing plate, a considerable reduction in the seating surface of the armature on the remaining lateral plate sections is also achieved so that the bearing friction becomes very low overall.

A further reduction in bearing friction is achieved when edges of the plate section which face toward the spring tongue are bent upward away from the armature by a small angle. This further reduces the seating surface for the armature and also prevents a sharp edge of the bearing plate from coming into contact with the bearing edge of the armature in all instances.

As already mentioned, the present pull-back spring only requires a little space since a significant part of the spring length already lies in the region of the bearing plate and thus requires no additional volume. Insofar as the arcuate or semiannular end section of the pull-back spring embraces the armature and projects beyond it, it is expedient to have it proceed at the outside lying parallel to the armature. The bearing and pullback spring thus requires practically no additional space extending beyond the armature space.

For fastening the bearing plate onto the yoke, the bearing plate expediently includes applied fastening tabs at both sides thereof which embrace the yoke. Each fastening tab is guided into a recess in the yoke. Each fastening tab has a catch or projection at both respective corners of its free end which are hooked onto edges of the recess in the yoke. This double arrangement of fastening tabs has an advantage for the bearing plate in that the overall leaf spring and, thus, the armature as well can be more exactly positioned, compared to the relay disclosed in the aforementioned European application No. 0 251 034. Thus, the response reliability is, in turn, assured at the lowest excitation power.

As described above, a section of the pull-back spring is engaged in a recess in the armature. Preferably, the recess in the armature is formed as a through opening, or window, whereby the tip of the pull-back spring extends into and presses against an inside wall of the through opening. An armature with such a through opening is very simple to manufacture.

To enhance the operationally reliability of the relay, an expedient embodiment provides bent limiting tabs at the long sides of the bearing plate at both sides of the armature. The armature at most strikes these lateral limiting tabs in a punctiform fashion at its rotational axis so that friction during movement of the armature is not likely to be increased even given dislocation of the armature out of its central bearing position, for instance, due to impact. An additional anti-impact measure provides that end-face limiting tabs may also be included at the end faces of the plate sections.

The leaf spring of the present is expediently composed of steel, for example of chrome-nickel steel, which has good magnetic conduction so that the conduction of magnetic flux through the bearing is improved.

DESCRIPTION OF THE PREFERRED EMBODIMENTS

Figure 1:
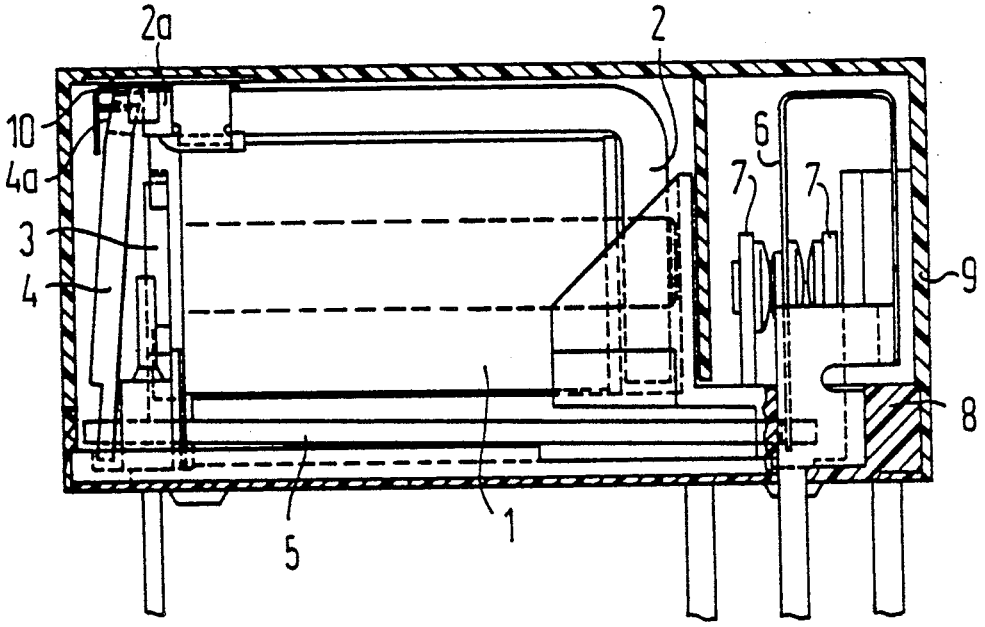
FIG. 1 is a side elevational view of the relay of the present invention shown in a housing which is shown in cross section.

A relay is shown in FIG. 1 having a magnetic system including a coil 1, an angle yoke 2, a core 3, and a plate-shaped armature 4 seated at a free end 2*a* of the yoke to form a working air gap together with the core 3. Via a rod shaped slide 5, the armature 4 actuates a U-shaped contact spring 6 that is switchable between stationary cooperating contact elements 7. The contact spring 6 and the cooperating contact elements 7 are anchored in a base member 8 which, together with a cap 9, forms a housing for the relay.

Figure 2:
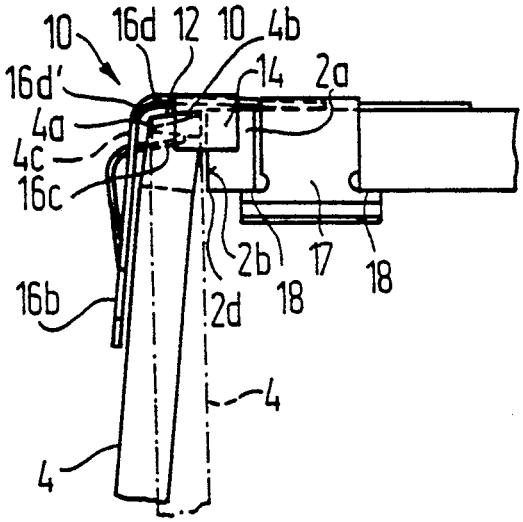
FIG. 2 is an enlarged side elevational view of the bearing region of the armature of FIG. 1.
Figure 3:
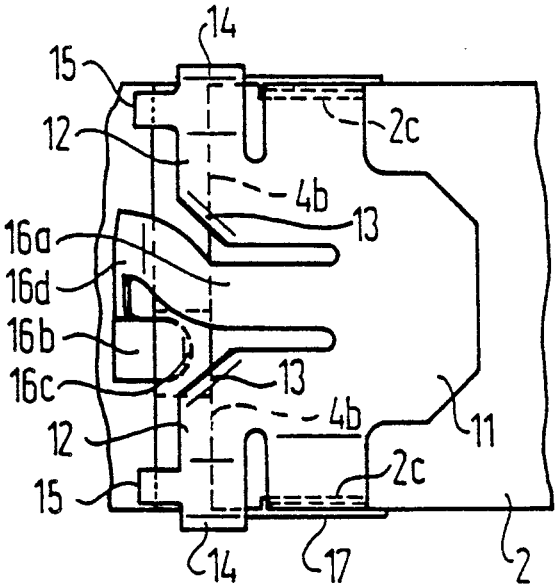
FIG. 3 is an enlarged plan view of the bearing region of the armature of FIG. 1.

The relay of FIG. 1 includes a leaf spring 10 which will now be described in greater detail with reference to FIGS. 2–5. The leaf spring 10 of the invention serves as a bearing element, or bearing plate, for bearing and resetting the armature 4. The leaf spring 10 has a section 11, shown in FIG. 3, which presses against the free end 2*a* of the yoke 2 and which serves as a bearing plate. The bearing plate section 11 projects beyond the free end 2*a* of the yoke 2. A center part 16*a* is cut free from the bearing plate section 11 so that two lateral plate sections 12 are formed. The leaf spring 10 is shaped to form an approximately right angled bearing notch, or slot, together with an end face 2*b* of the yoke 2, as shown in FIG. 2, in which an acute-angled bearing edge or bearing blade 4*b* of the armature 4 lies. Due to the central portion 16*a* being cut free, the armature 4 rests only on relatively short portions of the plate sections 12 so that there is little bearing friction. The extent to which the armature rests on the plate sections 12 is referred to as the seating distance, and the seating distance of the preferred embodiment is further diminished in that inside edges 13 of the plate sections 12 are bent up somewhat away from the armature 4 so that only a small surface of the plate sections support the armature 4 at each end of the bearing edge 4*b*, and so that no sharp edges press against the armature 4.

Moreover, each of the plate sections 12 include limiting tabs 14 which are bent down to lie opposite the lateral edges of the armature 4. The armature 4 may strike against these limiting tabs 14 if it is moved out of its middle position due, for example, to an impact. However, the armature 4 only strikes the limiting tabs 14 in punctiform fashion and then only in the region of its rotational axis so that there is no significant increase in friction during armature movement as a result thereof. In addition, end-face limiting tabs 15 are bent downwardly to intercept the armature 4 given impact in a direction perpendicular to the rotational axis or parallel to the coil axis. The armature 4 is thus, held in place by the tabs 14 and 15.

Since the leaf spring 10 also serves the purpose of pulling the armature 4 back to its quiescent position, a pull-back spring 16 is provided in a single piece therewith, the pull-back spring 16 having approximately the shape of a question mark if projected in a plane. A tongue-shaped straight section 16*a* is cut free from a central region of the bearing plate 11, i.e. between the plate sections 12. As a result thereof, an elongated soft, or weak, spring is formed without requiring additional space. An approximately semi-annular, or arcuate, section 16*b* of the pullback spring 16 proceeds approximately symmetrically relative to the center axis of the tongue section 16*a*. A tip 16*c* of the tongue section is turned back toward the armature 4 and points nearly toward the center of the tongue shaped section 16*a*. The overall semi-annular or arcuate section 16*b*, however, is bent around the edge 4*b* of the armature 4 and to a large extent lies parallel to the armature 4 so that the spring requires no additional space when the bearing plate for the armature 4 in the housing that is necessary anyway is taken into consideration.

The tip 16*c* of the pull-back spring 16 engages into a window-shaped opening 4*c* in the armature 4 and lies against an inside wall of the window opening so that a pull-back moment is exerted on the armature 4 around the bearing edge 4*b*. FIG. 2 shows the armature 4 in solid outline in its dropped off condition while the armature 4 is shown in broken outline in its attracted position.

Figure 4:
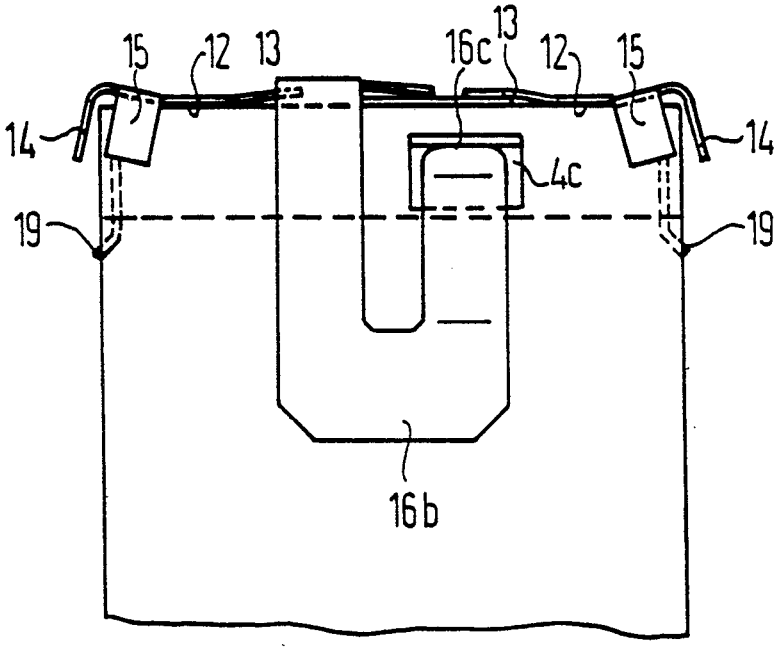
FIG. 4 is an enlarged end view of the bearing region of the armature of FIG. 1.
Figure 5:
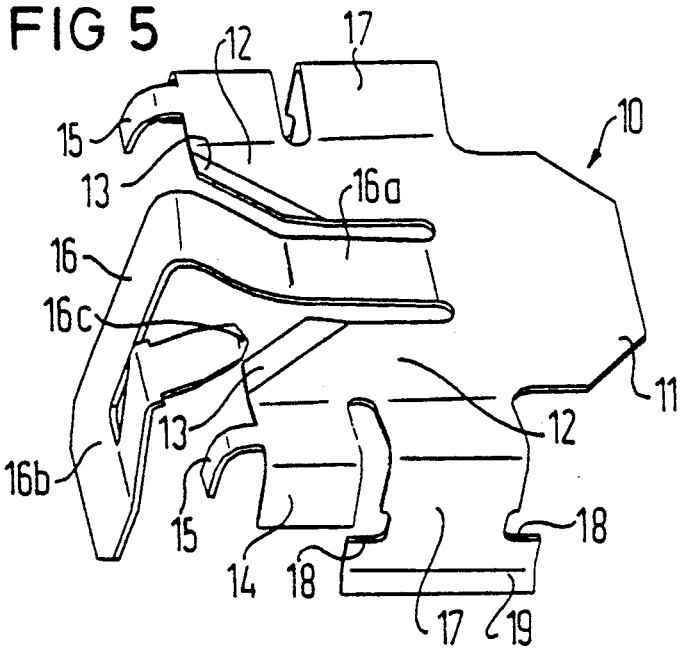
FIG. 5 is a perspective view of the bearing plate and pull-back spring, or leaf spring, according to the principles of the present invention for a relay.

The leaf spring 10 of the invention is hooked to the yoke 2 with two laterally applied fastening tabs 17 that embrace the yoke 2 at both sides. The fastening tabs 17 lie in recesses 2*c* of the yoke 2. The ends of the tabs 17 are broadened at both sides and, thus, form catch projections 18 with which the fastening tabs 17 are hooked to the edges of the recesses 2*c* in a double sided fashion. An extremely exact and reliable positioning of the bearing plate sections 12 and of the pull back spring 16 derives as a result of the double fastening. As can be seen in FIGS. 4 and 5, the fastening tabs 17 have angled ends 19 which enable easy placement of the leaf spring 10 onto the yoke 2 during assembly without requiring additional, special tools.

During assembly, the leaf spring 10 is first plugged onto the yoke 2, as shown in FIG. 2. The armature 4 is then mounted and the spring sections 16*b* or the tip 16*c* is first bent back and then inserted into the window opening 4*c* of the armature 4. However, it is also possible to first join the armature 4 to the leaf spring 10 and then to plug the preassembled unit composed of the armature 4 and spring 10 onto the yoke 2. A section of the spring 16 and 16*d* that first projects upwardly due to its shaping, as shown in FIG. 2, is bent downward at 16*d*', as shown in FIG. 2, due to the prestress after the insertion of the armature 4, so that the space requirement for the spring is further reduced.

As shown in FIGS. 1 and 2, the armature has a slight bend in its top edge 4*a*. This results in a small gap between the yoke, and prevents the armature from tilting around the lower edge 2*d* of the end face 2*b*. Further, it provides an additional safety clearance between the tip 16*c* in the opening 4*c* and the end face 2*d* of the yoke.

Thus, there is provided a leaf spring and armature bearing element for use in a relay which reduces friction on the armature during movement thereof. The present leaf spring also provides a relatively weak spring without requiring much space in the relay housing. As a result of the reduced friction and weaker spring, less power is required to operate the relay, so that there is less taxing of power supplies and longer battery life. The present leaf spring also enables the relay to be compact and prevents the armature from being knocked out of place.

Although other modifications and changes may be suggested by those skilled in the art, it is the intention of the inventors to embody within the patent warranted hereon all changes and modifications as reasonably and properly come within the scope of their contribution to the art.

WE CLAIM:

1. An electromagnetic relay, comprising:

a core;

a coil about said core;

a yoke having a first end connected to said core and a second free end;

a flat armature having a bearing edge seated at said free end of said yoke and having a recess;

a leaf spring forming a bearing plate which lies against an outside surface of said yoke and projects beyond said free end of said yoke, said bearing plate forming a bearing notch between said bearing plate and said free end of said yoke in which said bearing edge of said armature lies;

a pull-back spring formed in one piece with said bearing plate and embracing said bearing edge of said armature, a first section of said pull-back spring formed as a straight spring tongue cut free from a middle region of said bearing plate, said first section subdividing said bearing plate into two plate sections onto which said armature presses only at lateral regions of said bearing edge; and a free end of said pull-back spring comprising a second section being cut arcuately in a plane of said leaf spring, said second section extending approximately uniformly at both sides of a plane of symmetry that intersects said spring tongue of said first section; and a third section of said pull-back spring extending in an opposite direction relative to said bearing plate and engaging into said recess of said armature.

2. An electromagnetic relay as claimed in claim 1, wherein said second section of said pull-back spring lies in a plane generally parallel to said armature.

3. An electromagnetic relay as claimed in claim 1, wherein two plate sections of said bearing plate has edges that face toward said spring tongue of said first section, said edges being bent away from said armature by a small angle.

4. An electromagnetic relay as claimed in claim 1, wherein said yoke has recesses and further comprising:

fastening tabs applied to said bearing plate at both sides to embrace said armature, said fastening tabs being positioned in respective ones of said recesses in said yoke and having free ends of said fastening tabs hooked to edges of said recesses with respective catch projections at both corners.

5. An electromagnetic relay as claimed in claim 1, wherein said recess in said armature is a through opening and said third section of the said pull-back spring has a tip lying against an inside wall of said through opening.

6. An electromagnetic relay as claimed in claim 1, further comprising:

limiting tabs provided at long sides of said two plate sections at both sides of said armature.

7. An electromagnetic relay as claimed in claim 1, further comprising:

end face limiting tabs extending from said leaf spring at end faces of said two plate sections for limiting movement of said armature.

8. An electromagnetic relay as claimed in claim 1, wherein said leaf spring is composed of steel having good magnetic conduction.

9. An electromagnetic relay as claimed in claim 8, wherein said steel is chrome-nickel steel.

10. A leaf spring for an electromagnetic relay having an armature mounted at a free end of a yoke, comprising:

a bearing plate lying flat against an outside surface of the yoke;

first and second fastening tabs extending from opposite sides of said bearing plate and bent in a first direction out of a plane of said bearing plate and adapted for engagement into recesses in opposite sides of the yoke;

first and second bearing plate sections extending beyond an end of said yoke at opposite lateral sides thereof, said bearing plate sections including lateral limiting tabs bent in said first direction to embrace opposite edges of the armature, said bearing plate sections forming bearing surfaces for the armature; and a spring formed in one piece with said bearing plate and said spring lying between said first and second bearing plate sections and being cut free from said bearing plate sections to form an elongated spring tongue, said elongated spring tongue having a doubled back portion with a free end directed toward said bearing plate, said elongated spring tongue being bent over an end of the armature and said free end thereof being fastenable into a recess in the armature.

11. A leaf spring as claimed in claim 10, further comprising:

end face limiting tabs bent in said first direction to embrace an end of the armature between said end face limiting tabs and a free end of the yoke.

12. A leaf spring as claimed in claim 10, wherein inside edges of said bearing plate sections directed toward said spring are bent up in a second direction generally opposite said first direction.

13. A leaf spring as claimed in claim 10, wherein said spring has an overall shape projected into a plane generally corresponding to the shape of a question mark.

14. A leaf spring as claimed in claim 10, wherein said fastening tabs include widened sections at their free ends to form catch projections for engagement at edges of recesses in the yoke.

* * * * *